US011850700B2

(12) United States Patent
Oh et al.

(10) Patent No.: US 11,850,700 B2
(45) Date of Patent: Dec. 26, 2023

(54) SEQUENTIAL APPLICATION OF CLEANING FLUIDS FOR IMPROVED MAINTENANCE OF CHEMICAL MECHANICAL POLISHING SYSTEMS

(71) Applicant: Applied Materials, Inc., Santa Clara, CA (US)

(72) Inventors: Jeonghoon Oh, Saratoga, CA (US); Jamie Stuart Leighton, Palo Alto, CA (US); Roger M. Johnson, Livermore, CA (US); Van H. Nguyen, Milpitas, CA (US)

(73) Assignee: Applied Materials, Inc., Santa Clara, CA (US)

( * ) Notice: Subject to any disclaimer, the term of this patent is extended or adjusted under 35 U.S.C. 154(b) by 11 days.

(21) Appl. No.: 17/488,429

(22) Filed: Sep. 29, 2021

(65) Prior Publication Data

US 2022/0118583 A1 Apr. 21, 2022

Related U.S. Application Data

(60) Provisional application No. 63/094,551, filed on Oct. 21, 2020.

(51) Int. Cl.
*B24B 37/00* (2012.01)
*B24B 37/04* (2012.01)

(52) U.S. Cl.
CPC ..... *B24B 37/042* (2013.01)

(58) Field of Classification Search
CPC . B24B 37/042; B24B 53/017; B24B 27/0023; B24B 27/0069; B24B 37/005; B24B 49/08; B24B 49/18
See application file for complete search history.

(56) References Cited

U.S. PATENT DOCUMENTS 6,126,517 A 10/2000 Tolles et al.
6,227,947 B1 * 5/2001 Hu ..... B24B 53/013 451/443
(Continued)

FOREIGN PATENT DOCUMENTS

CN 102221416 A * 10/2011 ..... B24B 37/044
JP 2020161847 A * 10/2020 ..... B08B 1/003
(Continued)

OTHER PUBLICATIONS

International Search Report/Written Opinion issued to PCT/US2021/052011 dated Jan. 3, 2022.

*Primary Examiner* — Joel D Crandall
*Assistant Examiner* — Alyssa R Williams
(74) *Attorney, Agent, or Firm* — Patterson + Sheridan, LLP

(57) ABSTRACT

An apparatus and method for sequential application of cleaning fluids for improved maintenance of chemical mechanical polishing (CMP) systems is disclosed. A method includes transferring a first substrate to a first polishing station of a plurality of polishing stations, polishing the first substrate at the first polishing station, transferring the first substrate to a second polishing station, and transferring a second substrate to the first polishing station. The method includes cleaning a first surface of a plurality of surfaces of the polishing system by dispensing a first cleaning fluid from a first one or more nozzles of a plurality of nozzles to direct the first cleaning fluid onto the first surface and dispensing a second cleaning fluid from the first one or more nozzles to direct the second cleaning fluid onto the first surface, where the second cleaning fluid is different from the first cleaning fluid.

20 Claims, 4 Drawing Sheets

(56) References Cited

U.S. PATENT DOCUMENTS

| | | | | |
|---|---|---|---|---|
| 6,319,105 | B1 | 11/2001 | Togawa et al. | |
| 2003/0139048 | A1* | 7/2003 | Wong | B24B 37/042 257/E21.228 |
| 2004/0171266 | A1* | 9/2004 | Chen | B24B 37/04 438/692 |
| 2006/0194525 | A1* | 8/2006 | Tolles | H01L 21/67051 451/66 |
| 2010/0048106 | A1* | 2/2010 | Wang | B24B 37/04 451/60 |
| 2014/0182633 | A1 | 7/2014 | Lin et al. | |
| 2018/0093360 | A1* | 4/2018 | Shinozaki | B24B 37/013 |

FOREIGN PATENT DOCUMENTS

| | | | | |
|---|---|---|---|---|
| KR | 100591163 | B1 | 6/2006 | |
| WO | WO-2004070778 | A2 * | 8/2004 | B24B 37/042 |
| WO | 2006032622 | A1 | 3/2006 | |
| WO | WO-2010062910 | A2 * | 6/2010 | B24B 37/013 |

* cited by examiner

SEQUENTIAL APPLICATION OF CLEANING FLUIDS FOR IMPROVED MAINTENANCE OF CHEMICAL MECHANICAL POLISHING SYSTEMS

CROSS-REFERENCE TO RELATED APPLICATIONS

This application claims the benefit of U.S. Provisional Patent Application Ser. No. 63/094,551, filed on Oct. 21, 2020, the entirety of which is herein incorporated by reference.

BACKGROUND

Field

Embodiments of the present disclosure generally relate to chemical mechanical polishing (CMP) systems used in the manufacturing of semiconductor devices. In particular, embodiments herein relate to schemes for sequential application of cleaning fluids for improved maintenance of CMP systems.

Description of the Related Art

Chemical mechanical polishing (CMP) is commonly used in the manufacturing of semiconductor devices to planarize or polish a layer of material deposited on a substrate surface. In a typical CMP process, a substrate is retained in a substrate carrier which presses the backside of the substrate towards a rotating polishing pad in the presence of a polishing fluid. Material is removed across the material layer surface of the substrate in contact with the polishing pad through a combination of chemical and mechanical activity which is provided by the polishing fluid and the relative motion of the substrate and the polishing pad.

A typical polishing fluid used in a CMP process may comprise an aqueous solution of one or more chemical constituents along with nanoscale abrasive particles suspended in the aqueous solution. Commonly, dried residues of the polishing fluid, such as agglomerations of abrasive particles, accumulate on component surfaces that are disposed above or otherwise proximate to the polishing pad during the polishing process. For example, dried residues of the polishing fluid often accumulate on surfaces of CMP system components that are disposed over a polishing pad as a polishing fluid is dispensed thereon, such as substrate carriers, pad conditioner assemblies, and/or fluid delivery arms. If the accumulated residue is not removed, agglomerations of abrasive particles may flake from the component surfaces onto the polishing pad and cause undesirable damage to the material surface of a substrate subsequently polished thereon. This damage often manifests as scratches, e.g., micro-scratches, on the substrate surface which may detrimentally affect the performance of a device formed thereon or in some circumstances, may render the device inoperable.

Unfortunately, removing the accumulated residue from component surfaces is generally laborious and time-consuming as the agglomerated abrasive particles often form cement-like layers. The result is undesirable extended and frequent polishing system downtime for consumable change-out and/or preventive maintenance (PM) procedures where the accumulated residue is manually cleaned from the component surfaces.

Accordingly, there is a need in the art for apparatus and methods that solve the problems described above.

SUMMARY

The present disclosure generally relates to chemical mechanical polishing (CMP) systems used in the manufacturing of semiconductor devices. In particular, embodiments herein relate to schemes for sequential application of cleaning fluids for improved maintenance of CMP systems.

In one embodiment, a method for processing substrates using a polishing system having a plurality of polishing stations includes transferring a first substrate to a first polishing station of the plurality of polishing stations, polishing the first substrate at the first polishing station, transferring the first substrate to a second polishing station of the plurality of polishing stations, and transferring a second substrate to the first polishing station. Between polishing the first substrate at the first polishing station and transferring the second substrate to the first polishing station, the method includes cleaning a first surface of a plurality of surfaces of the polishing system. The cleaning includes dispensing a first cleaning fluid from a first one or more nozzles of a plurality of nozzles to direct the first cleaning fluid onto the first surface of the plurality of surfaces and dispensing a second cleaning fluid from the first one or more nozzles of the plurality of nozzles to direct the second cleaning fluid onto the first surface of the plurality of surfaces, where the second cleaning fluid is different from the first cleaning fluid.

In another embodiment, a substrate polishing system includes a plurality of polishing stations and a cleaning system configured to direct one or more cleaning fluids onto one of a plurality of surfaces of the polishing system. The cleaning system includes a distribution manifold configured to receive first and second cleaning fluids from first and second fluid sources, respectively, a first inlet valve in fluid communication between the first fluid source and the distribution manifold for regulating flow of the first cleaning fluid, and a second inlet valve in fluid communication between the second fluid source and the distribution manifold for regulating flow of the second cleaning fluid. The cleaning system includes a plurality of spray nozzles configured to independently receive the first and second cleaning fluids from the distribution manifold, and where the plurality of spray nozzles are configured to independently dispense the first and second cleaning fluids therefrom, and a system controller for controlling the first and second inlet valves. The substrate polishing system includes a non-transitory computer readable medium having instructions stored thereon for a substrate processing method. The method includes transferring a first substrate to a first polishing station of the plurality of polishing stations, polishing the first substrate at the first polishing station, transferring the first substrate to a second polishing station of the plurality polishing stations, and transferring a second substrate to the first polishing station. Between polishing the first substrate at the first polishing station and transferring the second substrate to the first polishing station, the method includes cleaning a first surface of a plurality of surfaces of the polishing system. The cleaning includes dispensing a first cleaning fluid from a first one or more nozzles of a plurality of nozzles to direct the first cleaning fluid onto the first surface of the plurality of surfaces and dispensing a second cleaning fluid from the first one or more nozzles of the plurality of nozzles to direct the second cleaning fluid onto the first surface of the plurality of surfaces, where the second cleaning fluid is different from the first cleaning fluid.

In yet another embodiment, a non-transitory computer readable medium includes instructions stored thereon for a substrate processing method using a polishing system having a plurality of polishing stations. The method includes transferring a first substrate to a first polishing station of the plurality of polishing stations, polishing the first substrate at the first polishing station, transferring the first substrate to a second polishing station of the plurality polishing stations, and transferring a second substrate to the first polishing station. Between polishing the first substrate at the first polishing station and transferring the second substrate to the first polishing station, the method includes cleaning a first surface of a plurality of surfaces of the polishing system. The cleaning includes dispensing a first cleaning fluid from a first one or more nozzles of a plurality of nozzles to direct the first cleaning fluid onto the first surface of the plurality of surfaces and dispensing a second cleaning fluid from the first one or more nozzles of the plurality of nozzles to direct the second cleaning fluid onto the first surface of the plurality of surfaces, where the second cleaning fluid is different from the first cleaning fluid.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure generally relate to chemical mechanical polishing (CMP) systems used in the manufacturing of semiconductor devices. In particular, embodiments herein relate to schemes for sequential application of cleaning fluids for improved maintenance of CMP systems.

Figure 1:
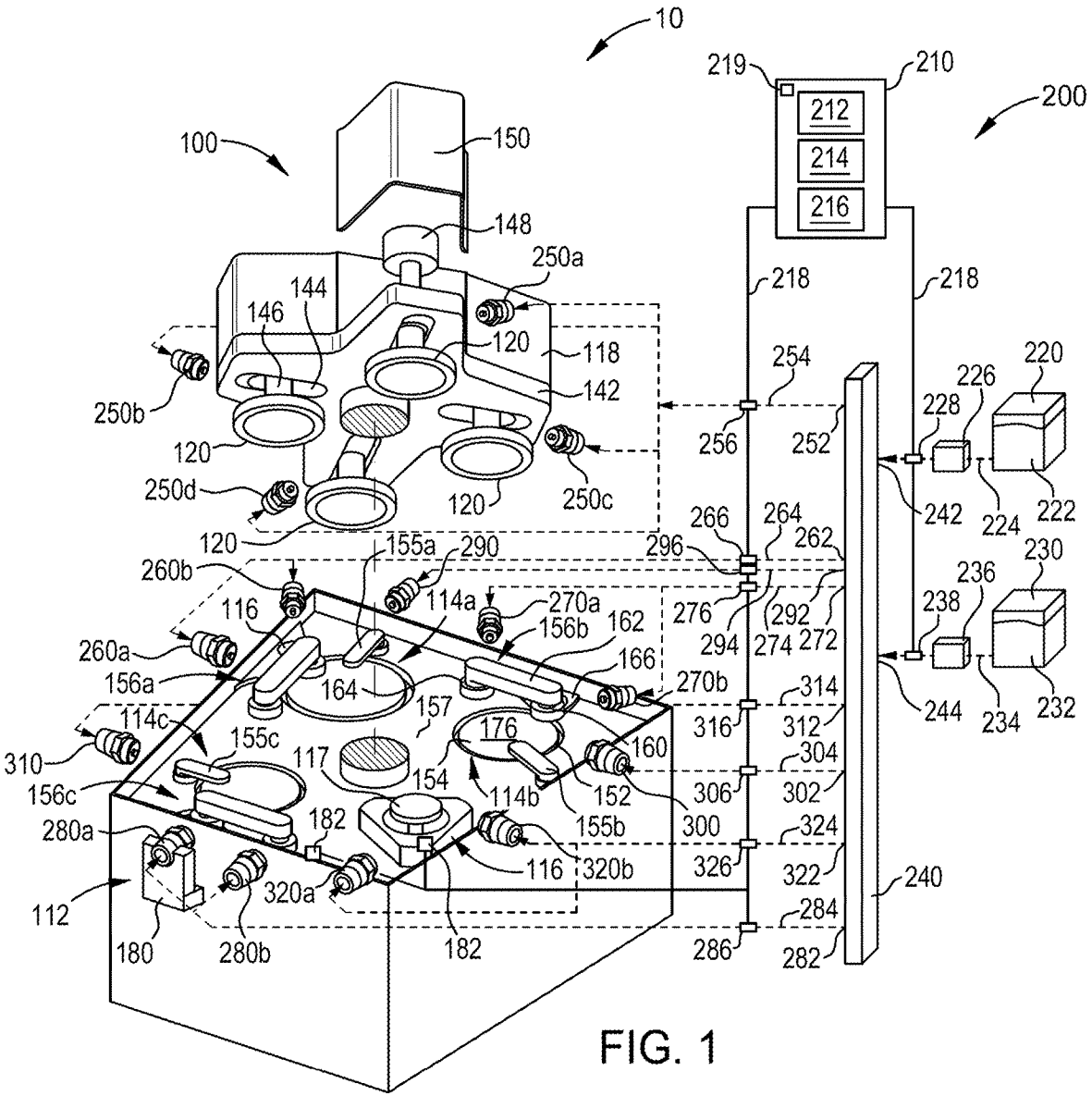
FIG. 1 is a schematic exploded isometric view of a chemical mechanical polishing (CMP) system, according to an embodiment.

FIG. 1 is a schematic exploded isometric view of a chemical mechanical polishing (CMP) system 10, according to an embodiment. Referring to FIG. 1, the CMP system 10 generally includes a multi-platen polishing system 100 having a surface cleaning system 200 incorporated therewith. The polishing system 100 generally includes a base 112, three independently-operated polishing stations 114*a-c*, a substrate transfer station 116, and a rotatable carousel 118 which choreographs the operation of four independently rotatable carrier heads 120.

The carousel 118 has a support plate 142 with slots 144 through which drive shafts 146 extend to support the carrier heads 120 and to rotate the carrier heads 120 about a carrier axis. Typically, the drive shafts 146 are coupled to an actuator (not shown) which oscillates the drive shafts 146 back-and-forth in the slots 144 to impart a sweeping motion to the carrier heads 120 relative a polishing pad 154 disposed there beneath. The carrier heads 120 are rotated by respective motors 148, which are normally hidden behind a removable cover 150 (one quarter of which is removed in FIG. 1) of the carousel 118. In operation, a substrate is loaded onto the transfer station 116, from which the substrate is transferred to a carrier head 120. The carousel 118 then transfers the substrate through a series of one or more polishing stations 114*a-c* and finally returns the polished substrate to the transfer station 116. The transfer station 116 includes a load cup 117 to facilitate loading and transfer of the substrate.

Each polishing station 114*a-c* includes a rotatable platen 152 which supports a polishing pad 154, a combined polishing fluid delivery/rinse arm 155*a-c*, and a pad conditioning apparatus 156*a-c*. Here, each polishing station 114*a-c* also includes a cleaning cup 166 that contains a cleaning solution, such as deionized water, for rinsing or cleaning a conditioner head 160. Typically, the platen 152 is disposed through a table top 157 and the polishing fluid delivery arm 155*a-c*, the pad conditioning apparatus 156*a-c*, and the cleaning cup 166 are mounted onto the table top 157 proximate to the platen 152.

Each polishing fluid delivery arm 155*a-c* delivers polishing fluid to an associated polishing pad 154 to facilitate the substrate polishing operation. In addition, the polishing fluid delivery arm 155*a-c* can deliver a cleaning fluid, e.g., deionized water, to the polishing pad 154 to rinse polishing byproducts from the polishing pad surface 176.

Each pad conditioning apparatus 156*a-c* includes an arm 162 that supports a conditioner head 160 over the respective polishing station 114*a-c*. The arm 162 is movably secured to the table top 157 at a base 164. A distal end of the arm 162 is coupled to the conditioner head 160, and a proximal end of the arm 162 is coupled to the base 164. The base 164 can rotate to pivot the arm 162 and thus move the conditioner head 160 across a polishing pad surface 176.

The CMP system 10 includes the surface cleaning system 200 for handling one or more cleaning fluids and dispensing the one or more cleaning fluids on components of the polishing system 100. The cleaning system 200 generally includes a system controller 210, a first fluid source 220, a second fluid source 230, a distribution manifold 240, and a plurality of spray nozzles.

The system controller 210 facilitates operation of the cleaning system 200. The system controller 210 includes a programmable central processing unit (CPU 212) which is operable with a memory 214 (e.g., non-volatile memory) and support circuits 216. The support circuits 216 are conventionally coupled to the CPU 212 and comprise cache, clock circuits, input/output subsystems, power supplies, and the like, and combinations thereof coupled to the various components the cleaning system 200, to facilitate control of a cleaning process. Here, the system controller 210 outputs power and instructions to components of the cleaning system 200 via wiring 218.

In some embodiments, the CPU 212 is one of any form of general purpose computer processor used in an industrial setting, such as a programmable logic controller (PLC), for controlling various cleaning system component and subprocessors. The memory 214, coupled to the CPU 212, is non-transitory and is typically one or more of readily available memory such as random access memory (RAM), read only memory (ROM), floppy disk drive, hard disk, or any other form of digital storage, local or remote.

Herein, the memory 214 is in the form of a computer-readable storage media containing instructions (e.g., non-volatile memory), that when executed by the CPU 212, facilitates the operation of the polishing system 100. The instructions in the memory 214 are in the form of a program product such as a program that implements the methods of the present disclosure (e.g., middleware application, equipment software application etc.). The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

The cleaning system 200 is in fluid communication with a plurality of cleaning fluid sources, such as the first fluid source 220, e.g., a supply tank, for delivering and/or storing a first cleaning fluid 222 and a second fluid source 230 for storing and/or delivering a second cleaning fluid 232. However, the cleaning system 200 is not particularly limited to the illustrated embodiment. For example, the cleaning system 200 may be in fluid communication with one or more additional fluid sources, e.g., supply tanks, for delivering and/or storing respective cleaning fluids. In some embodiments, the cleaning system 200 is in fluid communication with from 2 to 5 different fluid sources, such as from 2 to 4 fluid sources, such as from 2 to 3 fluid sources, such as 2 fluid sources, alternatively 3 fluid sources In some embodiments, the first and second cleaning fluids 222, 232 include one or more of water (e.g., deionized water), alcohols, amphiphilic compounds (e.g., detergents, soaps, lipoproteins, surfactants, synthetic amphiphiles, naturally-occurring amphiphiles), acids (e.g., citric acid, hydrogen peroxide), bases, oxidizing agents, reducing agents, hydrophilic compounds, hydrophobic compounds (e.g., oils, fats, waxes), or mixtures thereof.

The cleaning system 200 includes a first inlet line 224 fluidly coupling an outlet of the first fluid source 220 to a first inlet 242 of the manifold 240, the first inlet line 224 conveying the first cleaning fluid 222 therethrough. Here, the cleaning system 200 also includes a first pump 226 disposed along the first inlet line 224 between the first fluid source 220 and the manifold 240 for driving flow of the first cleaning fluid 222 through the first inlet line 224. The cleaning system 200 also includes a first inlet valve 228 disposed along the first inlet line 224 between the first pump 226 and the manifold 240 for regulating flow of the first cleaning fluid 222.

The cleaning system 200 includes a second inlet line 234 fluidly coupling an outlet of the second fluid source 230 to a second inlet 244 of the manifold 240, the second inlet line 234 conveying the second cleaning fluid 232 therethrough. Here, the cleaning system 200 also includes a second pump 236 disposed along the second inlet line 234 between the second fluid source 230 and the manifold 240 for driving flow of the second cleaning fluid 232 through the second inlet line 234. The cleaning system 200 also includes a second inlet valve 238 disposed along the second inlet line 234 between the second pump 236 and the manifold 240 for regulating flow of the second cleaning fluid 232.

The first and second inlet lines 224, 234 may be any tubing having chemical resistance to the cleaning fluids used therein and a pressure and temperature rating suitable for handling the first and second cleaning fluids 222, 232, respectively. In some embodiments, the tubing is formed from plastic or metal. The first and second pumps 226, 236 may be any pump having appropriate chemical resistance and a pressure and temperature rating suitable for handling the first and second cleaning fluids 222, 232, respectively. For example, the first and second pumps 226, 236 may be selected from a positive displacement pump, a variable displacement pump, an axial-flow pump, or a centrifugal pump. In some embodiments, the first and second inlet valves 228, 238 are selected from, for example, a proportional control valve (e.g., a motor or electrical solenoid flow rate control valve) or a shut-off valve. It will appreciated that the cleaning system 200 may also include shut-off valves, check valves, pressure relief valves, sensors (e.g., flowmeters, pressure, and/or temperature gauges), injection ports (i.e., for flushing the cleaning system 200 and/or for performing other maintenance), filters, bypass lines, waste lines, redundant components, other components, or combinations thereof.

The first and second pumps 226, 236 and the first and second inlet valves 228, 238 are communicatively coupled to the system controller 210 by wiring 218. In some embodiments, the system controller 210 includes a wireless transmitter 219, and the first and second pumps 226, 236 and first and second inlet valves 228, 238 each include wireless receivers (not shown) for communicating wirelessly with the system controller 210. In such embodiments, the wiring 218 may be omitted.

The system controller 210 may independently control the first and second pumps 226, 236 to control flow rates of the first and second cleaning fluids 222, 232, respectively. The system controller 210 may further independently control the first and second inlet valves 228, 238 to regulate flow of the first and second cleaning fluids 222, 232, respectively. A method for controlling the cleaning process is described in more detail below.

The distribution manifold 240 includes the first and second inlets 242, 244 for receiving the first and second cleaning fluids 222, 232 from the first and second fluid sources 220, 230, respectively. The manifold 240 is configured to distribute the first and second cleaning fluids 222, 232 to a plurality of outlets in fluid communication with one or more of the plurality of nozzles. Here the manifold 240 has 2 inlets and 8 outlets. However, the manifold 240 is not particularly limited to the illustrated embodiment. For example, the manifold 240 may have more than 2 inlets, such as from 2 to 5 inlets. The manifold 240 may have any number of outlets, such as from 1 to 10 outlets.

The manifold 240 includes a first outlet 252 in fluid communication with nozzles 250*a-d* for spraying one or more components of the carousel 118 (e.g., the support plate 142). A first outlet line 254 fluidly couples the first outlet 252 to the nozzles 250*a-d* for conveying one of the first and second cleaning fluids 222, 232 therethrough. A first outlet valve 256 is disposed along the first outlet line 254 for regulating flow of the first and second cleaning fluids 222, 232.

The manifold 240 includes a second outlet 262 in fluid communication with nozzles 260*a-b* for spraying a first pad conditioning apparatus 156*a*. A second outlet line 264 fluidly couples the second outlet 262 to the nozzles 260*a-b* for conveying one of the first and second cleaning fluids 222, 232 therethrough. A second outlet valve 266 is disposed along the second outlet line 264 for regulating flow of the first and second cleaning fluids 222, 232.

The manifold 240 includes a third outlet 272 in fluid communication with nozzles 270*a-b* for spraying a second pad conditioning apparatus 156*b*. A third outlet line 274 fluidly couples the third outlet 272 to the nozzles 270*a-b* for conveying one of the first and second cleaning fluids 222, 232 therethrough. A third outlet valve 276 is disposed along the third outlet line 274 for regulating flow of the first and second cleaning fluids 222, 232.

The manifold 240 includes a fourth outlet 282 in fluid communication with nozzles 280*a-b* for spraying a third pad conditioning apparatus 156*c*. A fourth outlet line 284 fluidly couples the fourth outlet 282 to the nozzles 280*a-b* for conveying one of the first and second cleaning fluids 222, 232 therethrough. A fourth outlet valve 286 is disposed along the fourth outlet line 284 for regulating flow of the first and second cleaning fluids 222, 232.

The manifold 240 includes a fifth outlet 292 in fluid communication with a nozzle 290 for spraying a first polishing fluid delivery arm 155*a*. A fifth outlet line 294 fluidly couples the fifth outlet 292 to the nozzle 290 for conveying one of the first and second cleaning fluids 222, 232 therethrough. A fifth outlet valve 296 is disposed along the fifth outlet line 294 for regulating flow of the first and second cleaning fluids 222, 232.

The manifold 240 includes a sixth outlet 302 in fluid communication with a nozzle 300 for spraying a second polishing fluid delivery arm 155*b*. A sixth outlet line 304 fluidly couples the sixth outlet 302 to the nozzle 300 for conveying one of the first and second cleaning fluids 222, 232 therethrough. A sixth outlet valve 306 is disposed along the sixth outlet line 304 for regulating flow of the first and second cleaning fluids 222, 232.

The manifold 240 includes a seventh outlet 312 in fluid communication with a nozzle 310 for spraying a third polishing fluid delivery arm 155*c*. A seventh outlet line 314 fluidly couples the seventh outlet 312 to the nozzle 310 for conveying one of the first and second cleaning fluids 222, 232 therethrough. A seventh outlet valve 316 is disposed along the seventh outlet line 314 for regulating flow of the first and second cleaning fluids 222, 232.

The manifold 240 includes an eighth outlet 322 in fluid communication with nozzles 320*a-b* for spraying one or more components of the transfer station 116 (e.g., the load cup 117). An eighth outlet line 324 fluidly couples the eighth outlet 322 to the nozzles 320*a-b* for conveying one of the first and second cleaning fluids 222, 232 therethrough. An eighth outlet valve 326 is disposed along the eighth outlet line 324 for regulating flow of the first and second cleaning fluids 222, 232.

The outlet lines and outlet valves are similar to the inlet lines and inlet valves, respectively, described above. For example, the outlet valves are communicatively coupled to the system controller 210 by wiring 218. Alternatively, the system controller 210 may include the wireless transmitter 219, and each outlet valve may include a wireless receiver (not shown) for communicating wirelessly with the system controller 210. In such embodiments, the wiring 218 may be omitted.

The system controller 210 may independently control each outlet valve to regulate flow of the first and second cleaning fluids 222, 232 to respective ones of the plurality of nozzles and to coordinate dispensing of the cleaning fluids 222, 232 with substrate processing operations at each of the polishing stations. A method for controlling the cleaning process is described in more detail below.

In some embodiments, the nozzles are formed from metal or plastic. In some embodiments, suitable metals include stainless steel (e.g., 303 or 316 stainless steel), brass, titanium, copper, nickel alloy, and alloys thereof. In some embodiments, suitable plastics include polyvinylchloride (PVC), chlorinated PVC, polypropylene, polytetrafluoroethylene, polyvinylidene fluoride, and combinations thereof. The nozzles may be selected from spray nozzles, fan nozzles, cone nozzles, wash nozzles, or other suitable nozzle types. In some embodiments, the nozzles are whirl-type nozzles. In some embodiments, the nozzles have a connection size of from about ⅛ inch to about 1 inch, such as from about ⅛ inch to about ½ inch, such as from about ⅛ inch to about ¼ inch. In some embodiments, the nozzles have a spray angle of from about 30 degrees to about 120 degrees, such as about 30 degrees, alternatively about 60 degrees, alternatively about 90 degrees, alternatively about 120 degrees. In some embodiments, the nozzles have an orifice diameter of from about 1/32 inch to about ¼ inch.

Here, the cleaning system 200 includes 8 different stations having from 1 to 4 nozzles in each station, configured for cleaning 8 different components of the polishing system 100. However, the cleaning system 200 is not particularly limited to the illustrated embodiment. For example, the cleaning system 200 may include any number of stations having any number of nozzles in each station. In some embodiments, the cleaning system 200 includes from 1 to 10 stations, such as from 1 to 8 stations, such as from 1 to 3 stations, alternatively from 4 to 5 stations, alternatively from 6 to 8 stations, such as 8 stations, alternatively from 8 to 10 stations. In some embodiments, each station includes from 1 to 5 nozzles, such as from 1 to 4 nozzles, such as from 1 to 2 nozzles, such as 1 nozzle, alternatively 2 nozzles, alternatively from 3 to 4 nozzles, such as 3 nozzles, alternatively 4 nozzles, alternatively 5 nozzles.

Here, each station is used to sequentially spray a different component of the polishing system 100 with the first and second cleaning fluids 222, 232. However, the cleaning system 200 is not particularly limited to the illustrated embodiment. For example, a single station may be used to spray 2 or more components, such as 3 or more components, such as 4 or more components. In some other embodiments, 2 or more stations can be used to spray the same component, such as 2 or more stations spraying the same component, such as 3 or more stations spraying the same component, such as 4 or more stations spraying the same component.

It will be appreciated that the plurality of nozzles illustrated in FIG. 1 are exemplary, and the cleaning system 200 may include one or more additional nozzles for cleaning one or more additional components of the polishing system 100. For example, the cleaning system 200 may include one or more additional nozzles for spraying one or more of the carrier heads 120, polishing pads 154, cleaning cups 166, or other components.

Referring to FIG. 1, the nozzles are shown schematically. It will be appreciated that each of the nozzles may be mounted to a support structure 180 and coupled, e.g., threaded, to a respective outlet line. Here, the support structure 180 is fixed. In some other embodiments, the support structure 180 and nozzles coupled thereto are movable relative to the polishing system 100 for repositioning and/or re-orienting a spray area provided by one or more of the nozzles.

Here, the support structure 180 is coupled to the polishing system 100 (e.g., to the base 112). In some other embodiments, the support structure 180 is coupled adjacent to the polishing system 100. In yet another embodiment, the support structure 180 is a standalone structure. In some embodiments, the cleaning system 200 is an extension of a preventative maintenance reduction kit and the nozzles may attach to a support structure thereof.

Figure 2:
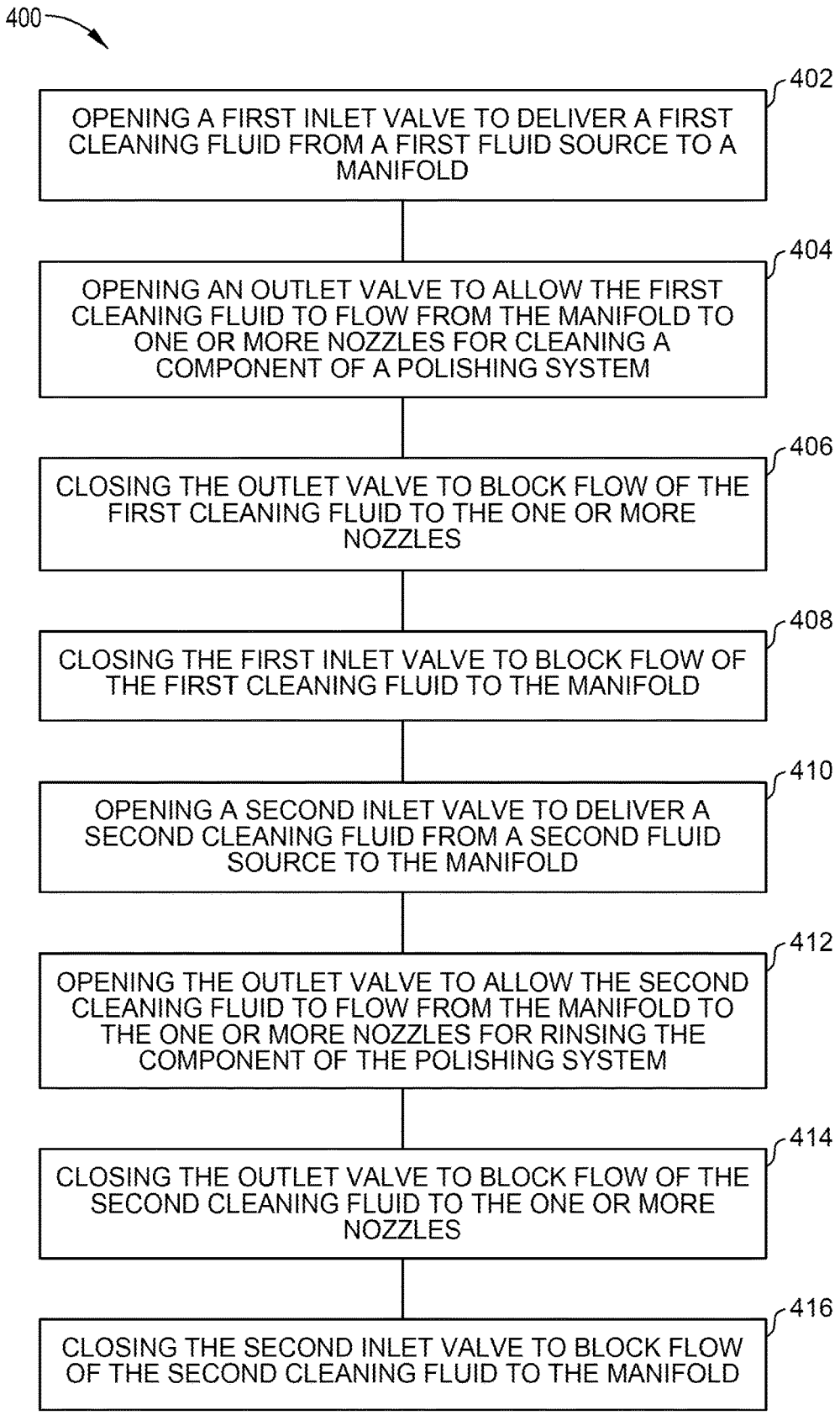
FIG. 2 is a diagram illustrating a method for controlling a cleaning process, according to an embodiment.

FIG. 2 is a diagram illustrating a method 400 for controlling a cleaning process, according to an embodiment. Generally, the method 400 includes cycling different cleaning fluids through the same cleaning station before, after, or concurrently with a substrate polishing operation on a polishing station.

At activity 402, the method 400 includes opening the first inlet valve 228 to deliver the first cleaning fluid 222 from the first fluid source 220 to the manifold 240. In some embodiments, the first inlet valve 228 is controlled programmatically by the system controller 210. Here, opening the first inlet valve 228 charges the manifold 240 with the first cleaning fluid 222. Here, the plurality of outlet valves are closed to block the first cleaning fluid 222 from being dispensed from the manifold 240.

At activity 404, the method 400 includes opening an outlet valve to allow the first cleaning fluid 222 to flow from the manifold 240 to one or more nozzles for cleaning a component of the polishing system 100. In some embodiments, the outlet valve is controlled programmatically by the system controller 210.

In one embodiment, the outlet valve is the first outlet valve 256, the one or more nozzles are the nozzles 250*a-d*, and the component of the polishing system 100 being cleaned is the carousel 118 (e.g., the support plate 142). In some other embodiments, the outlet valve, one or more nozzles, and component of the polishing system 100 may be any of the parts described and/or illustrated herein with respect to FIG. 1.

At activity 406, the method 400 includes closing the outlet valve to block flow of the first cleaning fluid 222 to the one or more nozzles. In one embodiment, the outlet valve is the first outlet valve 256 and the one or more nozzles are the nozzles 250*a-d*. In some other embodiments, the outlet valve and one or more nozzles may be any of the parts described and/or illustrated herein with respect to FIG. 1.

At activity 408, the method 400 includes closing the first inlet valve 228 to block flow of the first cleaning fluid 222 from the first fluid source 220 to the manifold 240.

In some embodiments, a residual volume or film of the first cleaning fluid 222 remaining on a component of the polishing system 100 is undesirably reactive with a processing fluid used in operation of the polishing system 100. In such embodiments, it may be desirable to rinse (or purge) the polishing system 100 with the second cleaning fluid 232 before starting the next substrate processing operation.

In some embodiments, the first cleaning fluid 222 is more expensive than the second cleaning fluid 232. In such embodiments, it may be desirable to reduce the use of the first cleaning fluid 222 in favor of the second cleaning fluid 232 by, for example, applying the first cleaning fluid 222 sparingly, and then switching to the second cleaning fluid 232 and applying the second cleaning fluid 232 more liberally, e.g., for a longer time period and/or at a higher flow rate.

At activity 410, the method 400 includes opening a second inlet valve 238 to deliver a second cleaning fluid 232 from the second fluid source 230 to the manifold 240. In some embodiments, the second inlet valve 238 is controlled programmatically by the system controller 210. Here, the plurality of outlet valves are closed to block the second cleaning fluid 232 from being dispensed from the manifold 240.

At activity 412, the method 400 includes opening the outlet valve to allow the second cleaning fluid 232 to flow from the manifold 240 to the one or more nozzles for rinsing the component of the polishing system 100. In some embodiments, the second cleaning fluid 232 prepares a surface of the component for a subsequent CMP processing operation. In one embodiment, the outlet valve is the first outlet valve 256, the one or more nozzles are the nozzles 250*a-d*, and the component of the polishing system 100 being rinsed is the carousel 118 (e.g., the support plate 142).

In some embodiments, the first cleaning fluid 222 is an amphiphilic solution including at least one of a detergent, a soap, a lipoprotein, a surfactant, a synthetic amphiphile, a naturally-occurring amphiphile, another amphiphilic substance, or combinations thereof. In some embodiments, the first cleaning fluid 222 is acidic. In some embodiments, the first cleaning fluid 222 includes hydrogen peroxide, citric acid, or both. In some embodiments, the first cleaning fluid 222 includes a mixture of two or more chemical compounds that produce a chemical reaction which improves the removal of at least one of unrinsed slurry, slurry buildup, other undesirable residues, or combinations thereof.

In some embodiments, the second cleaning fluid 232 is a hydrophilic solution including at least one of water, an alcohol, an acid, a base, another hydrophilic substance, or combinations thereof. In some other embodiments the second cleaning fluid 232 is a hydrophobic solution including at least one of an oil, a fat, a wax, another hydrophobic substance, or combinations thereof. In some embodiments, the second cleaning fluid 232 is chemically similar to the first cleaning fluid 222. In some embodiments, the second cleaning fluid 232 has a chemical composition that improves cleaning when the first and second cleaning fluids 222, 232 are used together in repeated sequential spray and rinse operations. In such embodiments, the first and second cleaning fluids 222, 232 undergo a chemical reaction that improves cleaning. In such embodiments, the first and second cleaning fluids 222, 232 have a difference in pH, concentration, or both which contributes to the cleaning efficiency induced by the chemical reaction.

In certain embodiments, the first cleaning fluid 222 is a mixture of hydrogen peroxide and citric acid having acidic pH, and the second cleaning fluid 232 is deionized water having neutral pH.

In some embodiments, the first cleaning fluid 222 has increased potency, compared to the second cleaning fluid 232, for cleaning one or more components of the polishing system 100. In other words, the first cleaning fluid 222 demonstrates improved cleaning, compared to the second cleaning fluid 232, by exhibiting comparable chemistry to one or more substances being cleaned. In some examples, the first cleaning fluid 222 is miscible with the substance being cleaned, and the second cleaning fluid 232 is immiscible with the substance being cleaned. In some embodiments, the first cleaning fluid 222 has comparable chemistry (e.g., miscibility) to a processing fluid (e.g., polishing fluid)

used in operation of the polishing system 100 and/or comparable chemistry (e.g., miscibility) to material build-up on a component of the polishing system 100, at least relative to the second cleaning fluid 232. Beneficially, due at least in part to the foregoing differences in the first and second cleaning fluids 222, 232, and sequential application thereof, the method 400 improves cleaning of the polishing system 100 compared to typical techniques using a single cleaning fluid.

In some embodiments, the second cleaning fluid 232 is operable to rinse the first cleaning fluid 222 off the polishing system 100 after the first cleaning fluid 222 removes the processing fluid, material build-up, or both. In such embodiments, the first cleaning fluid 222 cleans the polishing system 100 after which the second cleaning fluid 232 rinses the polishing system 100. In some embodiments, the second cleaning fluid 232 prepares a surface of the polishing system 100 for a subsequent CMP processing operation. In such embodiments, the second cleaning fluid 232 has comparable chemistry (e.g., miscibility) to a subsequent processing fluid (e.g., polishing fluid) used in operation of the polishing system 100, at least relative to the first cleaning fluid 222. In some embodiments, the first cleaning fluid 222 may be miscible with a slurry or slurry buildup for dissolving the slurry but may leave behind a residue of the first cleaning fluid 222. Then the second cleaning fluid 232 may be used to remove the residue of the first cleaning fluid 222. Beneficially, due at least in part to the foregoing differences in the first and second cleaning fluids 222, 232, and sequential application thereof, the method 400 improves cleaning of the polishing system 100 compared to typical techniques using a single cleaning fluid.

At activity 414, the method 400 includes closing the outlet valve to block flow of the second cleaning fluid 232 to the one or more nozzles. In one embodiment, the outlet valve is the first outlet valve 256 and the one or more nozzles are the nozzles 250*a-d*. In some other embodiments, the outlet valve and one or more nozzles may be any of the parts described and/or illustrated herein with respect to FIG. 1.

At activity 416, the method 400 includes closing the second inlet valve 238 to block flow of the second cleaning fluid 232 from the second fluid source 230 to the manifold 240.

The method 400 describes a process for cleaning one component of the polishing system 100. In some embodiments, the method 400 may be repeated for cleaning one or more additional components. In some embodiments, the activities of the method 400 are performed sequentially. Alternatively, the activities of the method 400 may be performed in any functional order. One or more activities may be omitted from the method 400.

In some embodiments, the method 400 is controlled programmatically, i.e., automatically, by the system controller 210. In some embodiments, the system controller 210 applies one or more predefined cleaning process routines. In some embodiments, a cleaning process routine can include one or more parameters including without limitation, dispensing time for each station, dispensing sequence of each station, number of cycles for each station, delay time between stations, respective flow rates of different cleaning fluids, dispensing sequence of different cleaning fluids, and delay time between different cleaning fluids.

In some embodiments, the system controller 210 programmatically determines parameters based on the substrate processing operation. In some other embodiments, the system controller 210 programmatically determines parameters for the cleaning process based on a maintenance condition of the polishing system 100 including without limitation, total runtime and runtime since last service, equipment lifespan, scheduled maintenance, error codes, repair requests, maintenance requests, and substrate processing performance and quality control. In some embodiments, the maintenance condition of the polishing system 100 is determined using one or more sensors 182 (FIG. 1). In one embodiment, a sensor 182 determines build-up of material on a component of the polishing system 100. In some embodiments, the system controller 210 dispenses one of the first and second cleaning fluids 222, 232 on the component to clean the component until the build-up of material is removed. The sensors 182 may be optical sensors directed toward one or more components of the polishing system 100. Here, the sensors 182 are communicatively coupled to the system controller 210 by wiring 218. In some other embodiments, the sensors 182 communicate with the system controller 210 wirelessly.

In some embodiments, the system controller 210 programmatically determines parameters for the cleaning process based on a cleaning condition of the polishing system 100. In some embodiments, the cleaning condition of the polishing system 100 is determined using the one or more sensors 182. In one embodiment, a sensor 182 detects a residual volume of the first cleaning fluid 222 remaining on a component of the polishing system 100. In another embodiment, a sensor 182 detects a reaction between a residual volume of the first cleaning fluid 222 and a processing fluid used in operation of the polishing system 100. In both embodiments, the system controller 210 may determine a precise location and/or particular component having the residual volume of the first cleaning fluid 222 remaining. In some embodiments, the system controller 210 activates one or more stations of the cleaning system 200 to target the component having the residual volume of the first cleaning fluid 222 remaining. In some embodiments, the system controller 210 dispenses the second cleaning fluid 232 on the component to rinse the component until the residual volume of the first cleaning fluid 222 is removed.

In some embodiments, the system controller 210 determines, by use of a sensor 182, a presence of a material residue on one of a plurality of surfaces of the polishing system 100, where the material residue may be polishing fluid, the first cleaning fluid 222, the second cleaning fluid 232, or a combination thereof. In some embodiments, the system controller 210 adjusts one or more parameters of a cleaning process routine based on the determination.

Figure 3:
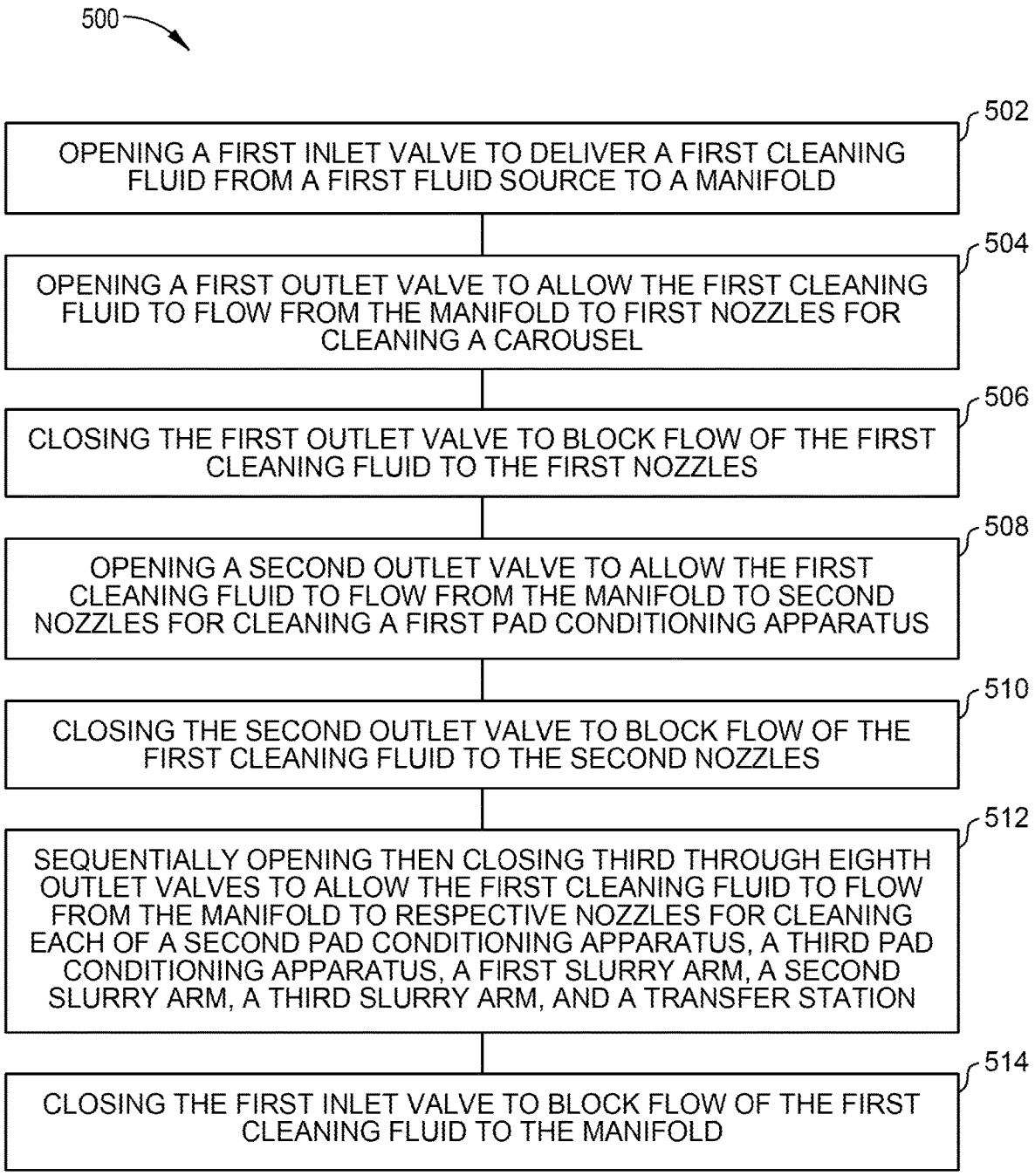
FIG. 3 is a diagram illustrating a method for controlling a cleaning process, according to another embodiment.

FIG. 3 is a diagram illustrating a method 500 for controlling a cleaning process, according to another embodiment. Generally, the method 500 includes cycling through different cleaning stations using the same cleaning fluid.

At activity 502, the method 500 includes opening the first inlet valve 228 to deliver the first cleaning fluid 222 from the first fluid source 220 to the manifold 240. In some embodiments, the first inlet valve 228 is controlled programmatically by the system controller 210. Here, opening the first inlet valve 228 charges the manifold 240 with the first cleaning fluid 222. Here, the plurality of outlet valves are closed to block the first cleaning fluid 222 from being dispensed from the manifold 240.

At activity 504, the method 500 includes opening the first outlet valve 256 to allow the first cleaning fluid 222 to flow from the manifold 240 to first nozzles 250*a-d* for cleaning the carousel 118 (e.g., the support plate 142). In some embodiments, the first outlet valve 256 is controlled programmatically by the system controller 210.

At activity 506, the method 500 includes closing the first outlet valve 256 to block flow of the first cleaning fluid 222 to the first nozzles 250*a-d*.

At activity 508, the method 500 includes opening the second outlet valve 266 to allow the first cleaning fluid 222 to flow from the manifold 240 to second nozzles 260*a-b* for cleaning the first pad conditioning apparatus 156*a*.

At activity 510, the method 500 includes closing the second outlet valve 266 to block flow of the first cleaning fluid 222 to the second nozzles 260*a-b*.

At activity 512, the method 500 includes sequentially opening then closing each of the third through eighth outlet valves 276, 286, 296, 306, 316, 326 to allow the first cleaning fluid 222 to flow from the manifold 240 to the respective nozzles for cleaning each of the second pad conditioning apparatus 156*b*, the third pad conditioning apparatus 156*c*, the first polishing fluid delivery arm 155*a*, the second polishing fluid delivery arm 155*b*, the third polishing fluid delivery arm 155*c*, and the transfer station 116 (e.g., the load cup 117), respectively.

Here the method 500 cycles through every station illustrated in FIG. 1. However, the method 500 is not particularly limited to the illustrated embodiment. In some embodiments, the method 500 may cycle through any combination of the first through eighth outlet valves and respective nozzles. In some embodiments, one or more stations of the cleaning system 200 may be skipped or repeated.

In some embodiments, the method 500 is controlled programmatically, i.e., automatically, by the system controller 210. In some embodiments, the system controller 210 applies one or more predefined cleaning process routines. In some embodiments, a cleaning process routine can include one or more parameters described herein with respect to the method 400. For example, the different stations may have the same or different runtimes. In some embodiments, runtimes of one or more stations are automatically adjusted using the system controller 210. For example, the runtimes may be automatically adjusted based on one or more of a maintenance condition, a cleaning condition, or a build-up of material as described elsewhere herein.

At activity 514, the method 500 includes closing the first inlet valve 228 to block flow of the first cleaning fluid 222 from the first fluid source 220 to the manifold 240.

The method 500 describes a process for dispensing one cleaning fluid. In some embodiments, the method 500 may be repeated for dispensing one or more additional cleaning fluids. In some embodiments, the activities of the method 500 are performed sequentially. Alternatively, the activities of the method 500 may be performed in any functional order. One or more activities may be omitted from the method 500.

In some embodiments, the method 500 may dispense the second cleaning fluid 232 instead of the first cleaning fluid 222. In some other embodiments, the method 500 may be for rinsing instead of cleaning. In some embodiments, any activities of the methods 400, 500 may be combined in any order.

Beneficially, combining aspects of the methods 400, 500 can improve cleaning of multiple components of the polishing system 100 compared to typical techniques using a single cleaning fluid.

Figure 4:
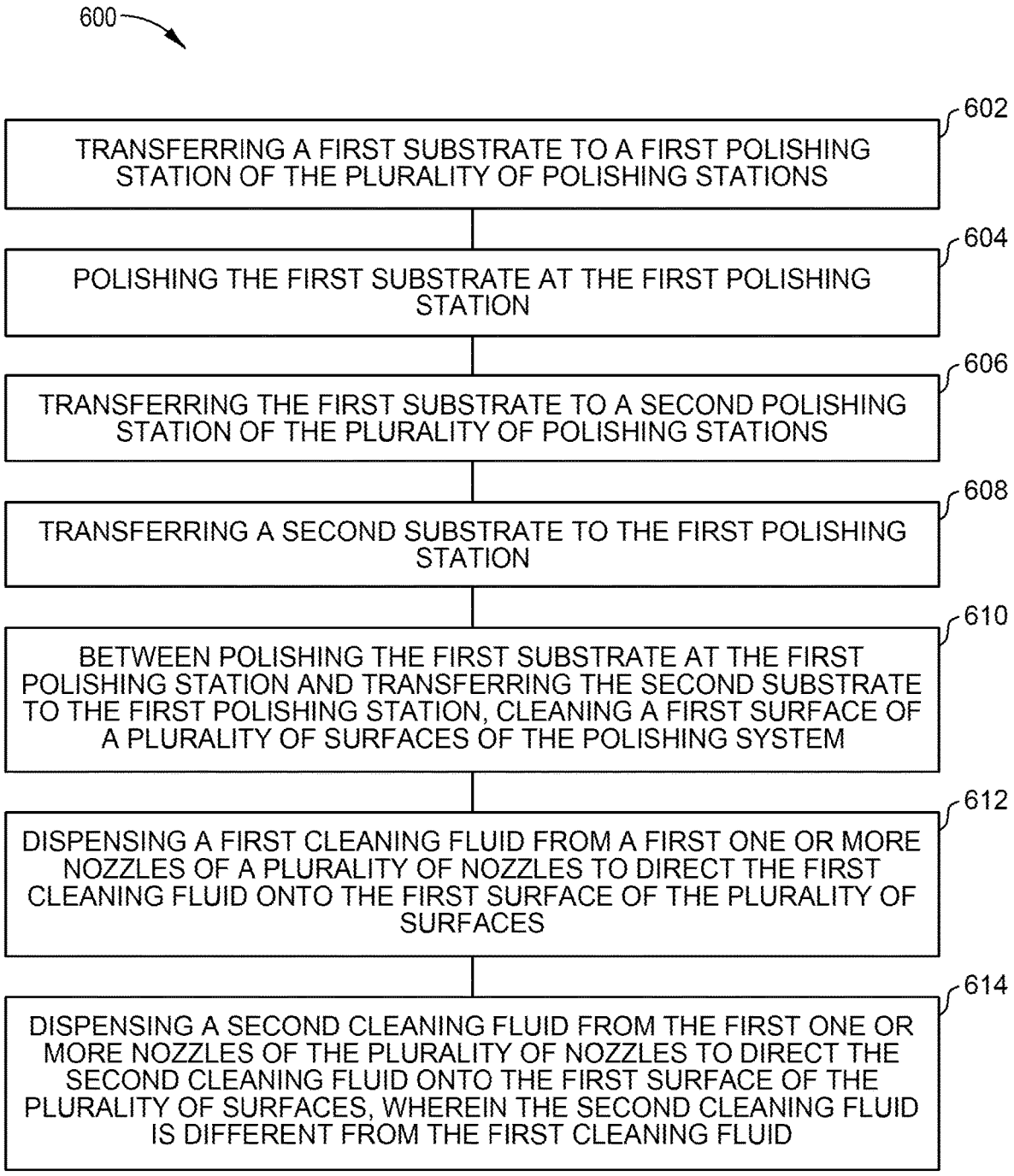
FIG. 4 is a diagram illustrating a method for processing substrates using a polishing system having a plurality of polishing stations, according to an embodiment.

FIG. 4 is a diagram illustrating a method 600 for processing substrates using a polishing system 100 having a plurality of polishing stations 114*a-c*, according to an embodiment.

At activity 602, the method 600 includes transferring a first substrate to a first polishing station (e.g., polishing station 114*a*) of the plurality of polishing stations 114*a-c*.

At activity 604, the method 600 includes polishing the first substrate at the first polishing station 114*a*.

At activity 606, the method 600 includes transferring the first substrate to a second polishing station (e.g., polishing station 114*b*) of the plurality of polishing stations 114*a-c*.

At activity 608, the method 600 includes transferring a second substrate to the first polishing station 114*a*.

At activity 610, the method 600 includes, between polishing the first substrate at the first polishing station 114*a* and transferring the second substrate to the first polishing station 114*a*, cleaning a first surface of a plurality of surfaces of the polishing system 100. In one embodiment, the first surface is a surface of the carousel 118. In some other embodiments, the first surface can be any surface of the polishing system 100 including, without limitation, at least one surface of the carousel 118 (e.g., the support plate 142), the first pad conditioning apparatus 156*a*, the second pad conditioning apparatus 156*b*, the third pad conditioning apparatus 156*c*, the first polishing fluid delivery arm 155*a*, the second polishing fluid delivery arm 155*b*, the third polishing fluid delivery arm 155*c*, or the transfer station 116 (e.g., the load cup 117).

At activity 612, the method 600 includes dispensing a first cleaning fluid 222 from a first one or more nozzles of a plurality of nozzles to direct the first cleaning fluid 222 onto the first surface of the plurality of surfaces. In one embodiment, the first one or more nozzles are the nozzles 250*a-d*. In some other embodiments, the first one or more nozzles may be any of the nozzles described and/or illustrated herein with respect to FIG. 1.

At activity 614, the method 600 includes dispensing a second cleaning fluid 232 from the first one or more nozzles of the plurality of nozzles to direct the second cleaning fluid 232 onto the first surface of the plurality of surfaces, wherein the second cleaning fluid 232 is different from the first cleaning fluid 222.

In some embodiments, the system controller 210 includes a non-transitory computer readable medium having instructions stored thereon for implementing a substrate processing method according to any of the methods 400, 500, or 600.

While the foregoing is directed to embodiments of the present disclosure, other and further embodiments of the disclosure may be devised without departing from the basic scope thereof, and the scope thereof is determined by the claims that follow.

The invention claimed is:

1. A method for processing substrates using a polishing system having a plurality of polishing stations, the method comprising:

transferring a first substrate to a first polishing station of the plurality of polishing stations;

polishing the first substrate at the first polishing station;

transferring the first substrate to a second polishing station of the plurality of polishing stations;

transferring a second substrate to the first polishing station; and between polishing the first substrate at the first polishing station and transferring the second substrate to the first polishing station, cleaning a first surface of one type of component of a plurality of surfaces of the polishing system, the cleaning comprising:

delivering a first cleaning fluid to a first inlet of a manifold, the manifold comprising a first outlet connected to a first nozzle of a plurality of nozzles operable to direct fluid to the first surface of one type of component, and a second outlet connected to a second nozzle of the plurality of nozzles operable to direct fluid from the manifold to a second surface of a second type of component in the first polishing station, the second type of component being different than the first type of component;

dispensing the first cleaning fluid from the first nozzle of the plurality of nozzles to direct the first cleaning fluid from the manifold onto the first surface of the plurality of surfaces; and dispensing a second cleaning fluid from the first nozzle of the plurality of nozzles to direct the second cleaning fluid from the manifold onto the first surface of the plurality of surfaces, wherein the second cleaning fluid is different from the first cleaning fluid.

2. The method of claim 1, wherein dispensing the first and second cleaning fluids from the first nozzle of the plurality of nozzles comprises:

opening an outlet valve to allow the first cleaning fluid to flow from the manifold to the first nozzle of the plurality of nozzles;

closing the outlet valve to block flow of the first cleaning fluid to the first nozzle of the plurality of nozzles;

stopping delivery of the first cleaning fluid to the manifold;

delivering a second cleaning fluid to the manifold; and opening the outlet valve to allow the second cleaning fluid to flow from the manifold to the first nozzle of the plurality of nozzles.

3. The method of claim 2, further comprising, after closing the outlet valve to block flow of the first cleaning fluid to the first nozzle of the plurality of nozzles, opening another outlet valve to allow the first cleaning fluid to flow from the manifold to the second nozzle of the plurality of nozzles to direct the first cleaning fluid onto a second surface of the plurality of surfaces.

4. The method of claim 2, wherein delivering the first cleaning fluid to the manifold comprises:

operating a first pump to drive flow of the first cleaning fluid from a first fluid source to the manifold; and operating a first inlet valve in fluid communication between the first fluid source and the manifold to regulate flow of the first cleaning fluid.

5. The method of claim 2, wherein delivering the second cleaning fluid to the manifold comprises:

operating a second pump to drive flow of the second cleaning fluid from a second fluid source to the manifold; and operating a second inlet valve in fluid communication between the second fluid source and the manifold to regulate flow of the second cleaning fluid.

6. The method of claim 2, wherein opening and closing the outlet valve is performed according to a cleaning process routine.

7. The method of claim 1, further comprising:

determining, by use of a sensor, a presence of a material residue on one of the plurality of surfaces of the polishing system, wherein the material residue comprises polishing fluid, the first cleaning fluid, the second cleaning fluid, or a combination thereof; and adjusting one or more parameters of a cleaning process routine based on the determination.

8. The method of claim 7, wherein the one or more parameters of the cleaning process routine include at least one of: respective dispensing times of the first and second cleaning fluids, a number of cycles for dispensing the first and second cleaning fluids, a delay time between dispensing the first and second cleaning fluids, respective flow rates of the first and second cleaning fluids, and a dispensing sequence of the first and second cleaning fluids.

9. A substrate polishing system, comprising:

a plurality of polishing stations;

a cleaning system configured to direct one or more cleaning fluids onto one of a plurality of surfaces of the polishing system, the cleaning system comprising:

a distribution manifold configured to receive first and second cleaning fluids from first and second fluid sources, respectively;

a first inlet valve in fluid communication between the first fluid source and the distribution manifold for regulating flow of the first cleaning fluid;

a second inlet valve in fluid communication between the second fluid source and the distribution manifold for regulating flow of the second cleaning fluid;

a plurality of spray nozzles configured to independently receive the first and second cleaning fluids from the distribution manifold, and wherein the plurality of spray nozzles are configured to independently dispense the first and second cleaning fluids therefrom; and a system controller for controlling the first and second inlet valves; and a non-transitory computer readable medium having instructions stored thereon which, when executed by a processor, causes the process to perform a substrate processing method, the method comprising:

transferring a first substrate to a first polishing station of the plurality of polishing stations;

polishing the first substrate at the first polishing station;

transferring the first substrate to a second polishing station of the plurality polishing stations;

transferring a second substrate to the first polishing station; and between polishing the first substrate at the first polishing station and transferring the second substrate to the first polishing station, cleaning a first surface of one type of component of a plurality of surfaces of the polishing system, the cleaning comprising:

delivering the first cleaning fluid to a first inlet of the distribution manifold, the manifold comprising a first outlet connected to a first nozzle of the plurality of spray nozzles operable to direct fluid to the first surface of one type of component, and a second outlet connected to a second nozzle of the plurality of spray nozzles operable to direct fluid from the manifold to a second surface of a second type of component in the first polishing station, the second type of component being different than the first type of component;

dispensing the first cleaning fluid from the first nozzle of the plurality of spray nozzles to direct the first cleaning fluid from the distribution manifold onto the first surface of the plurality of surfaces; and dispensing the second cleaning fluid from the second zozzle of the plurality of spray nozzles to direct the second cleaning fluid from the distribution manifold onto the first surface of the plurality of surfaces, wherein the second cleaning fluid is different from the first cleaning fluid.

10. The substrate polishing system of claim 9, wherein the first cleaning fluid is amphiphilic, and wherein the second cleaning fluid is hydrophilic.

11. The substrate polishing system of claim 10, wherein the first cleaning fluid is a detergent, and wherein the second cleaning fluid is water.

12. The substrate polishing system of claim 9, wherein the first cleaning fluid is amphiphilic, and wherein the second cleaning fluid is hydrophobic.

13. The substrate polishing system of claim 12, wherein the first cleaning fluid is a detergent, and wherein the second cleaning fluid is an oil.

14. A non-transitory computer readable medium having instructions stored thereon for a substrate processing method using a polishing system having a plurality of polishing stations, the method comprising:

transferring a first substrate to a first polishing station of the plurality of polishing stations;

polishing the first substrate at the first polishing station;

transferring the first substrate to a second polishing station of the plurality polishing stations;

transferring a second substrate to the first polishing station; and between polishing the first substrate at the first polishing station and transferring the second substrate to the first polishing station, cleaning a first surface of one type of component of a plurality of surfaces of the polishing system, the cleaning comprising:

delivering a first cleaning fluid to a first inlet of a manifold, the manifold comprising a first outlet connected to a first nozzle of a plurality of nozzles operable to direct fluid to the first surface of one type of component, and a second outlet connected to a second nozzle of the plurality of nozzles operable to direct fluid from the manifold to a second surface of a second type of component in the first polishing station, the second type of component being different than the first type of component;

dispensing the first cleaning fluid from the first nozzle of the plurality of nozzles to direct the first cleaning fluid from the manifold onto the first surface of the plurality of surfaces; and dispensing a second cleaning fluid from the first nozzle of the plurality of nozzles to direct the second cleaning fluid from the manifold onto the first surface of the plurality of surfaces, wherein the second cleaning fluid is different from the first cleaning fluid.

15. The computer readable medium of claim 14, wherein dispensing the first and second cleaning fluids from the first nozzle of the plurality of nozzles comprises:

opening an outlet valve to allow the first cleaning fluid to flow from the manifold to the first nozzle of the plurality of nozzles;

closing the outlet valve to block flow of the first cleaning fluid to the first nozzle of the plurality of nozzles;

stopping delivery of the first cleaning fluid to the manifold;

delivering a second cleaning fluid to the manifold; and opening the outlet valve to allow the second cleaning fluid to flow from the manifold to the first nozzle of the plurality of nozzles.

16. The computer readable medium of claim 15, further comprising instructions stored thereon for, after closing the outlet valve to block flow of the first cleaning fluid to the first nozzle of the plurality of nozzles, opening another outlet valve to allow the first cleaning fluid to flow from the manifold to second nozzle of the plurality of nozzles to direct the first cleaning fluid onto a second surface of the plurality of surfaces.

17. The computer readable medium of claim 15, wherein delivering the first cleaning fluid to the manifold comprises:

operating a first pump to drive flow of the first cleaning fluid from a first fluid source to the manifold; and operating a first inlet valve in fluid communication between the first fluid source and the manifold to regulate flow of the first cleaning fluid.

18. The computer readable medium of claim 15, wherein delivering the second cleaning fluid to the manifold comprises:

operating a second pump to drive flow of the second cleaning fluid from a second fluid source to the manifold; and operating a second inlet valve in fluid communication between the second fluid source and the manifold to regulate flow of the second cleaning fluid.

19. The computer readable medium of claim 15, further comprising instructions stored thereon for opening and closing the outlet valve programmatically according to a cleaning process routine.

20. The computer readable medium of claim 14, further comprising instructions stored thereon for:

determining, by use of a sensor, a presence of a material residue on one of the plurality of surfaces of the polishing system, wherein the material residue comprises polishing fluid, the first cleaning fluid, the second cleaning fluid, or a combination thereof; and adjusting one or more parameters of a cleaning process routine based on the determination.

* * * * *